US010633067B2

(12) United States Patent
Kray et al.

(10) Patent No.: US 10,633,067 B2
(45) Date of Patent: Apr. 28, 2020

(54) METHOD AND SYSTEM FOR IMPROVING FLOW CHARACTERISTICS IN MARINE PROPELLERS

(71) Applicant: General Electric Company, Schenectady, NY (US)

(72) Inventors: Nicholas Joseph Kray, Mason, OH (US); Stefaan Guido Van Nieuwenhove, Bavaria (DE); Peggy Lynn Baehmann, Glenville, NY (US)

(73) Assignee: General Electric Company, Schenectady, NY (US)

( * ) Notice: Subject to any disclaimer, the term of this patent is extended or adjusted under 35 U.S.C. 154(b) by 485 days.

(21) Appl. No.: 15/295,303

(22) Filed: Oct. 17, 2016

(65) Prior Publication Data

US 2018/0105242 A1 Apr. 19, 2018

(51) Int. Cl.

| | |
|---|---|
| ***B63H 1/20*** | (2006.01) |
| ***B63H 1/28*** | (2006.01) |
| ***F01D 11/00*** | (2006.01) |

(52) U.S. Cl.

CPC ..... *B63H 1/20* (2013.01); *B63H 1/28* (2013.01); *F01D 11/008* (2013.01)

(58) Field of Classification Search

CPC .... B63H 1/20; B63H 1/26; B63H 1/28; F01D 11/008; F01D 5/143; F04D 29/329

USPC ..... 416/234, 245 A, 244 B, 244 R; 415/58.2

See application file for complete search history.

(56) References Cited

U.S. PATENT DOCUMENTS

| | | | | |
|---|---|---|---|---|
| 123,274 A * | 1/1872 | McCay | F04D 29/34 416/214 R |
| 856,586 A * | 6/1907 | Humphery | F04D 29/34 416/214 R |
| 1,010,929 A | 12/1911 | Loetzer | |
| 1,050,119 A | 1/1913 | Flanders | |

(Continued)

FOREIGN PATENT DOCUMENTS

| | | |
|---|---|---|
| CA | 2 241 610 A1 | 12/1999 |
| FR | 330 906 A | 8/1903 |

(Continued)

OTHER PUBLICATIONS

Composite material—Wikipedia, the free encyclopedia (Year: 2015).*

(Continued)

*Primary Examiner* — Kenneth J Hansen
*Assistant Examiner* — Maranatha Boardman
(74) *Attorney, Agent, or Firm* — Dority & Manning, P.A.

(57) ABSTRACT

A propeller assembly is provided. The propeller assembly includes a central hub including a forward end, an aft end, and a hub body extending therebetween along an axis of rotation of the central hub. The propeller assembly further includes a first retention member including a first radial interference member, the first retention member coupled to the forward end of the central hub and a second retention member including a second radial interference member, the second retention member coupled to the aft end of the central hub. The propeller assembly also includes a fairing platform extending between the first retention member and the second retention member, wherein the fairing platform is retained by the first radial interference member and by the second radial interference member.

20 Claims, 9 Drawing Sheets

(56) References Cited

U.S. PATENT DOCUMENTS

| | | | | |
|---|---|---|---|---|
| 1,122,925 | A * | 12/1914 | Hemrichsen | F04D 29/34 416/212 R |
| 1,133,191 | A * | 3/1915 | Staples | F04D 29/34 416/214 R |
| 3,246,699 | A * | 4/1966 | Jocz | B63H 1/20 29/889.6 |
| 3,764,228 | A * | 10/1973 | Shook | B63H 1/20 416/134 R |
| 3,876,331 | A * | 4/1975 | DenHerder | B63H 1/20 416/134 R |
| 4,466,776 | A | 8/1984 | Camboulives | |
| 4,482,298 | A | 11/1984 | Hannon et al. | |
| 4,930,987 | A | 6/1990 | Stahl | |
| 5,018,941 | A | 5/1991 | Heurtel et al. | |
| 5,180,286 | A * | 1/1993 | Dean | B63H 1/20 29/889.6 |
| 5,256,035 | A | 10/1993 | Norris et al. | |
| 5,277,548 | A | 1/1994 | Klein et al. | |
| 5,611,665 | A | 3/1997 | Angel | |
| 6,176,680 | B1 * | 1/2001 | Ringblom | 416/212 A |
| 6,312,223 | B1 | 11/2001 | Samuelsson | |
| 6,506,019 | B2 * | 1/2003 | Lin | B63H 3/002 416/214 R |
| 6,537,031 | B1 | 3/2003 | Bacskay | |
| 7,056,092 | B2 * | 6/2006 | Stahl | B63H 1/14 416/129 |
| 8,235,666 | B2 | 8/2012 | Rosenkranz et al. | |
| 8,608,446 | B2 | 12/2013 | Pickens et al. | |
| 8,851,852 | B2 | 10/2014 | Blatchford | |
| 9,011,100 | B2 * | 4/2015 | Ulgen | B63H 1/20 416/212 R |
| 9,039,378 | B2 | 5/2015 | Ulgen | |
| 9,051,845 | B2 | 6/2015 | Bommanakatte et al. | |
| 9,068,465 | B2 | 6/2015 | Keny et al. | |
| 9,944,372 | B1 * | 4/2018 | Stahl | B63H 1/26 |
| 10,118,710 | B2 * | 11/2018 | Derrez | B64C 11/02 |
| 2014/0079553 | A1 | 3/2014 | Ulgen | |
| 2018/0105240 | A1 | 4/2018 | Kray et al. | |

FOREIGN PATENT DOCUMENTS

| | | | |
|---|---|---|---|
| FR | 372 910 | A | 4/1907 |
| JP | S62-111300 | U | 7/1987 |
| SU | 1 105 388 | A1 | 7/1984 |

OTHER PUBLICATIONS

International Search Report and Written Opinion issued in connection with corresponding PCT Application No. PCT/US2017/051094 dated Nov. 28, 2017.

* cited by examiner

METHOD AND SYSTEM FOR IMPROVING FLOW CHARACTERISTICS IN MARINE PROPELLERS

BACKGROUND

The field of the disclosure relates generally to propulsion systems and, more particularly, to a method and system for improved flow characteristics of composite marine propellers.

At least some known marine propulsion systems rely on a rotating propeller assembly including a central hub and propeller blades extending from the central hub. During operation, fluid generally flows across surfaces of the propeller assembly and through gaps defined between blades of the propeller assembly. Performance of the propeller assembly is highly dependent on the shape of the propeller assembly surfaces including those of the blades and the central hub. As a result, propeller assemblies in which the shape of propeller assembly components are limited by construction methods, material limitations, component sizes, and the like, may result in sub-optimal flow characteristics, decreasing the efficiency of the propeller assembly and requiring more powerful drive systems to achieve required propulsion.

BRIEF DESCRIPTION

In one aspect, a propeller assembly is provided. The propeller assembly includes a central hub including a forward end, an aft end, and a hub body extending therebetween. The propeller assembly further includes a first retention member including a first radial interference member, the first retention member coupled to the forward end of the central hub, and a second retention member including a second radial interference member, the second retention member coupled to the aft end of the central hub. The propeller assembly also includes a fairing platform extending between the first retention member and the second retention member, wherein the fairing platform is retained by the first radial interference member and by the second radial interference member.

In another aspect, a fairing structure supportable by a central hub of a propeller assembly, the central hub including a forward end, an aft end, and a hub body extending therebetween, is provided. The fairing structure includes a first retention member including a first radial interference member, the first retention member couplable to the forward end of the central hub, and a second retention member including a second radial interference member, the second retention member couplable to the aft end of the central hub. The fairing structure further includes a fairing platform extending between said first retention member and said second retention member, said fairing platform configured to engage said first radial interference member and said second radial interference member.

In yet another aspect a method of manufacturing a fairing structure supportable by a central hub, the fairing structure including a fairing platform including a radially outer platform surface is provided. The method includes determining a first flow coefficient for a first propeller assembly including the central hub without the fairing structure. The method further includes determining a platform profile for the radially outer platform surface such that a second propeller assembly including the radially outer platform having the platform profile has a second flow coefficient greater than the first coefficient. The method also includes forming the fairing platform such that the radially outer platform surface substantially conforms to the platform profile.

DRAWINGS

These and other features, aspects, and advantages of the present disclosure will become better understood when the following detailed description is read with reference to the accompanying drawings in which like characters represent like parts throughout the drawings, wherein.

Figure 1:
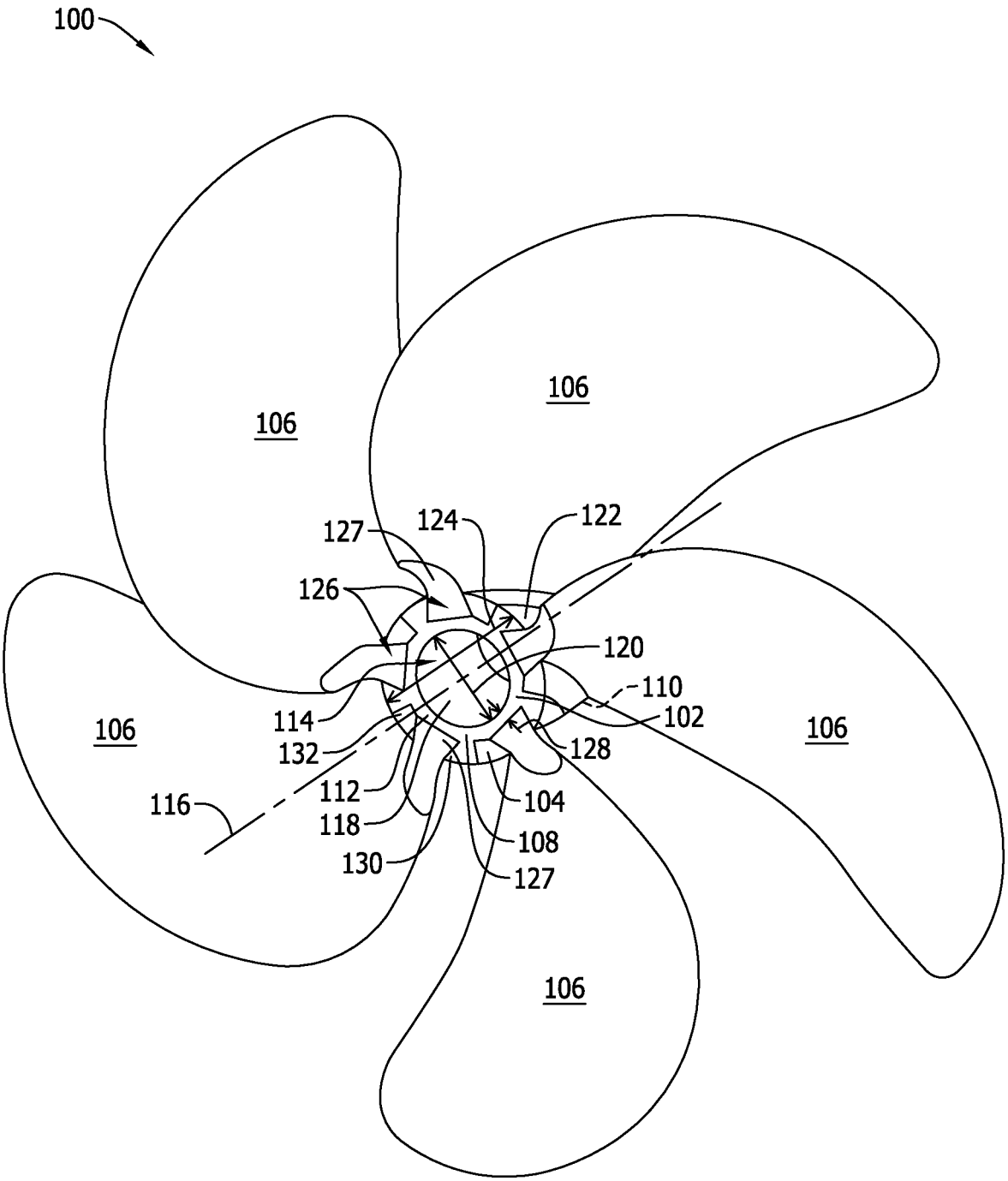
FIG. 1 is a perspective view of a marine propeller assembly in accordance with an example embodiment of the present disclosure.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a," "an," and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

As used herein, the terms "axial" and "axially" refer to directions and orientations that extend substantially parallel to a centerline of the propeller assembly. Moreover, the terms "radial" and "radially" refer to directions and orientations that extend substantially perpendicular to the centerline of the propeller assembly. In addition, as used herein, the terms "circumferential" and "circumferentially" refer to directions and orientations that extend arcuately about the centerline of the propeller assembly.

Embodiments of the systems and methods described herein provide improved flow characteristics for marine propeller assemblies. Systems described herein include a fairing structure configured to be included in a propeller assembly. The fairing structure generally includes forward and second retention members configured to be coupled to forward and aft faces of a central propeller hub, respectively. The forward and second retention members are configured to retain and support a fairing platform therebetween. The fairing platform includes a radially outer surface configured to facilitate efficient flow of fluid across the propeller assembly and, in particular, between adjacent propeller blades of the propeller assembly. The radially outer surface of the fairing platform is generally shaped such that the propeller assembly including the fairing platform has a flow coefficient that exceeds that of the propeller assembly without the fairing platform, i.e., with the central hub exposed between adjacent blades.

While described in the context of a marine propeller, it should be understood that the systems and methods described herein are also applicable to other propulsion and turbomachine systems including, without limitation, turboprop engines, turboshaft engines, turbojet engines, open rotor engines, and any other turbine engine where improved flow characteristics are desirable.

FIG. 1 is a perspective view of a marine propeller assembly 100 in accordance with an example embodiment of the present disclosure with a fairing structure 150 (shown in FIGS. 3 and 4) removed. In the example embodiment, marine propeller assembly 100 includes a hub 102, a plurality of wedges 104, and a plurality of separable blades 106.

Hub 102 includes a first face 108, a second face 110 (not shown in FIG. 1, facing away from the view in FIG. 1), and a hub body 112 extending between first face 108 and second face 110. In the example embodiment, first face 108 is spaced axially forward of second face 110. Hub body 112 includes a central bore 114 that is axisymmetric with an axis of rotation 116 of marine propeller assembly 100. Bore 114 includes a radially inner bore surface 118 having an internal diameter (ID) 120. Hub 102 includes a radially outer hub surface 122 having an outer diameter (OD) 124. In one embodiment, outer hub surface 122 includes a plurality of dovetail grooves 126 that extend radially inwardly from outer hub surface 122 a predetermined depth 128. Each of the plurality of dovetail grooves 126 extend generally axially along hub body 112 from first face 108 to second face 110. Each of the plurality of dovetail grooves 126 includes a first undercut sidewall 130 and a second sidewall 132 spaced apart circumferentially. Each of the plurality of dovetail grooves 126 is configured to receive a respective wedge 104 of the plurality of wedges 104 and a dovetail 127 of respective blade 106 of the plurality of separable blades 106.

Figure 2:
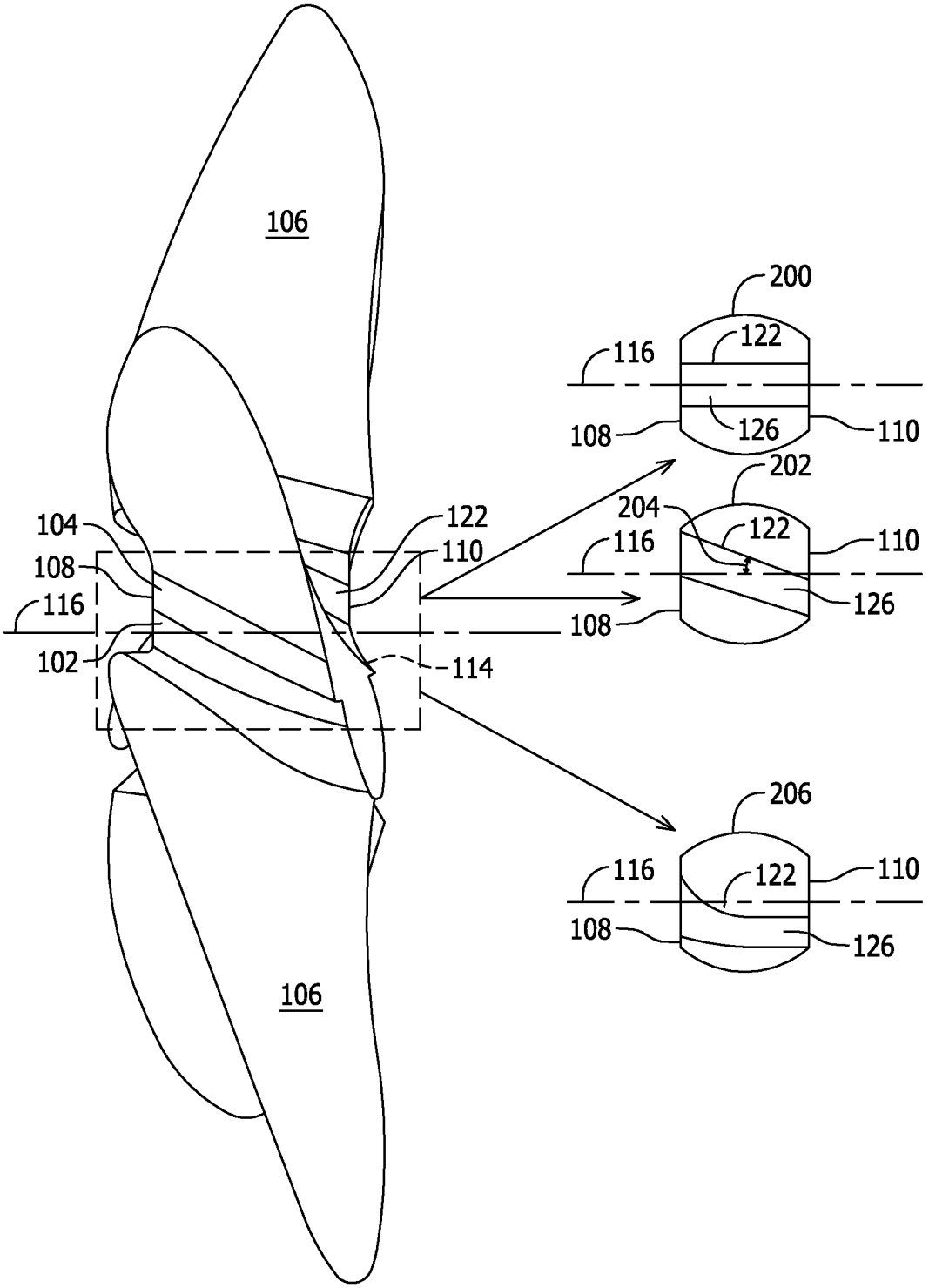
FIG. 2 is a side view of the marine propeller assembly of FIG. 1.

FIG. 2 is a side view of marine propeller assembly 100 with fairing structure 150 (shown in FIGS. 3 and 4) removed. In the example embodiment, a detail 200 of hub 102 illustrates dovetail groove 126 that extends straight axially between first face 108 and second face 110 parallel to axis of rotation 116. A detail 202 illustrates dovetail groove 126 that extends linearly at a skew angle 204 between first face 108 and second face 110. A detail 206 illustrates dovetail groove 126 that extends arcuately between first face 108 and second face 110.

Figure 3:
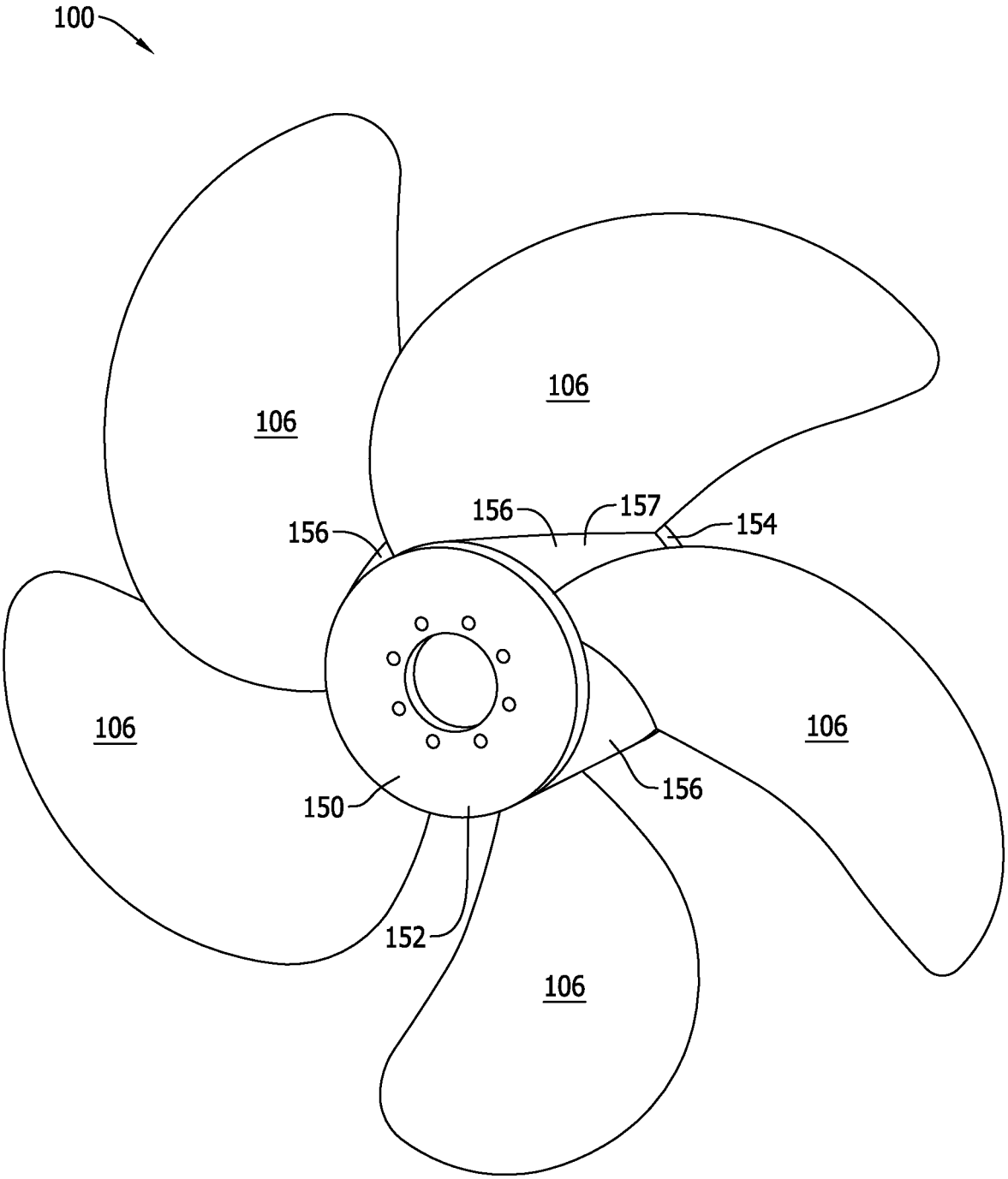
FIG. 3 is a perspective view of the marine propeller assembly of FIG. 1 further including a fairing structure.

FIG. 3 is a perspective view of marine propeller assembly 100 including fairing structure 150. Fairing structure 150 is supportable by hub 102 (shown in FIG. 1) and includes a first retention member 152 couplable to first face 108 (shown in FIG. 1), a second retention member 154 couplable to second face 110 (shown in FIG. 1), and a fairing platform 156 extending between first retention member 152 and second retention member 154. Fairing platform 156 further includes a radially outer platform surface 157. Although depicted as distinct annular structures, first retention member 152 and second retention member 154 may be incorporated into other components including, but not limited to, a propeller cone, a propeller shaft, and a propeller coupling. Fairing platform 156 generally extends between adjacent blades of the plurality of separable blades 106.

In certain alternative embodiments, fairing structure 150 is retained by other components of propeller assembly 100. In such alternative embodiments, first retention member 152 and second retention member 154 may be omitted from marine propeller assembly. For example, in one alternative embodiment, fairing structure 150 is configured to receive a radial retention member, such as a pin, rod, bolt, or fastener, configured to extend through fairing structure 150 in a radial direction and to couple fairing structure 150 to one of hub body 112 and one of the plurality of wedges 104. In another alternative embodiment, fairing structure 150 includes a lip, an overhang, a hook, or a similar feature configured to couple with a complementary feature, such as a groove, of one or more of first face 108 and second face 110.

Figure 4:
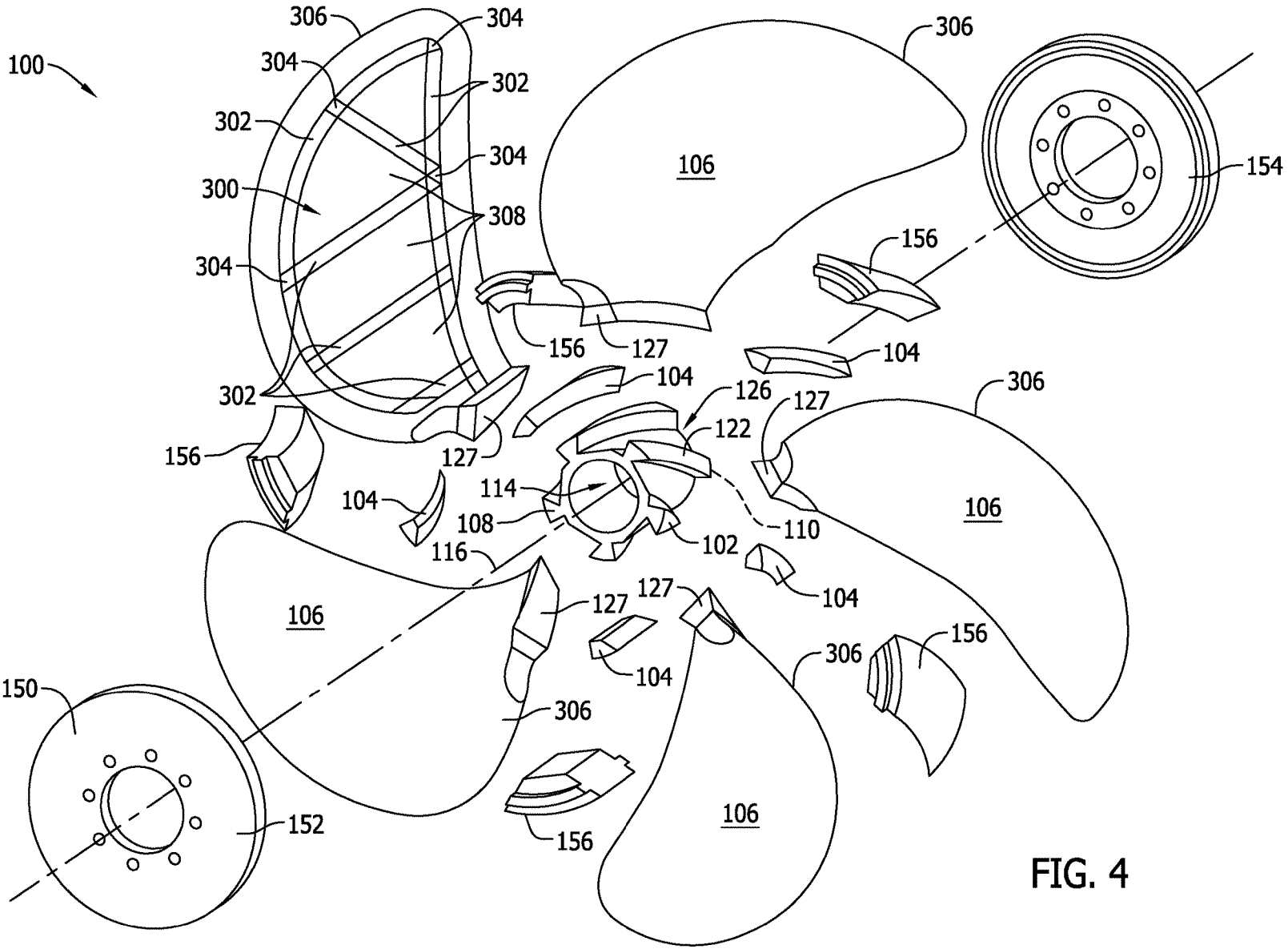
FIG. 4 is an exploded view of the marine propeller assembly of FIG. 3.

FIG. 4 is an exploded view of marine propeller assembly 100 in accordance with an example embodiment of the present disclosure. In the example embodiment, hub 102 is illustrated with plurality of dovetail grooves 126 extending arcuately between first face 108 and second face 110. A blade 106 is illustrated cutaway showing an interior structure 300 that may be used in one embodiment. Interior structure 300 includes a plurality of frame members 302 coupled together at respective frame joints 304. In various embodiments, dovetail 127 is formed of a metallic material and coupled to a respective composite blade portion 306 of a respective blade 106 of plurality of blades 106. In other embodiments, dovetail 127 is formed of a composite material. In various embodiments, each blade 106 may be formed using interior structure 300, which may be at least partially surrounded by a filler material, such as, but not limited to, a foamed material 308. Propeller assembly 100 includes fairing structure 150, which further includes first retention member 152, second retention member 154, and a plurality of fairing platforms 156 extending between first retention member 152 and second retention member 154.

Figure 5:
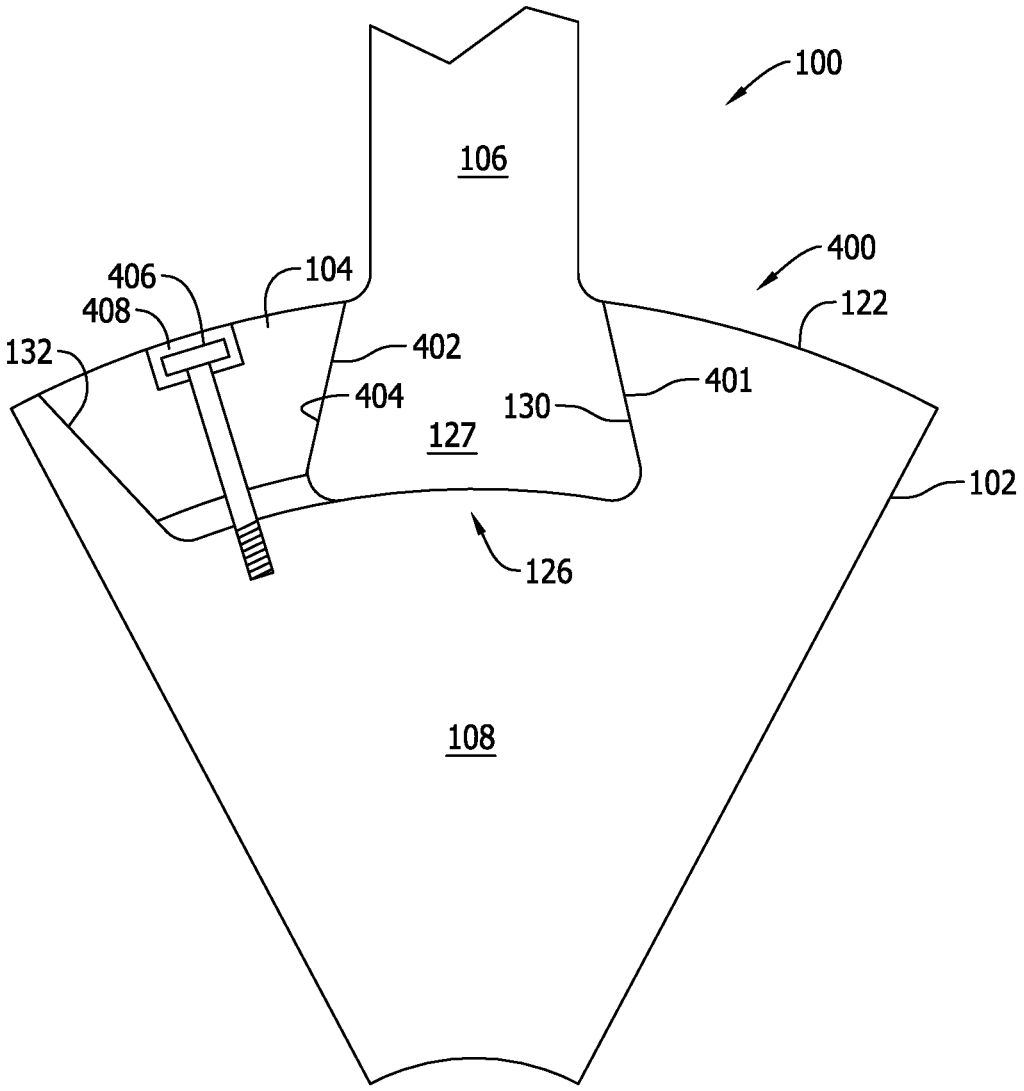
FIG. 5 is an axial view, looking forward of a circumferential segment of the marine propeller assembly of FIG. 1.

FIG. 5 is an axial view, looking forward of a circumferential segment 400 of marine propeller assembly 100 (shown in FIG. 1). In the example embodiment, dovetail 127 is retained in dovetail groove 126 by undercut sidewall 130 engaging a complementary first dovetail sidewall 401 and by a first wedge sidewall 402 engaging a complementary second dovetail sidewall 404. Wedge 104 is retained in dovetail groove 126 by one or more fasteners, such as, but not limited to, one or more threaded fasteners 406, for example, one or more bolts. In the example embodiment, a head 408 of fastener 406 is countersunk into a radially outer surface of wedge 104.

Figure 6:
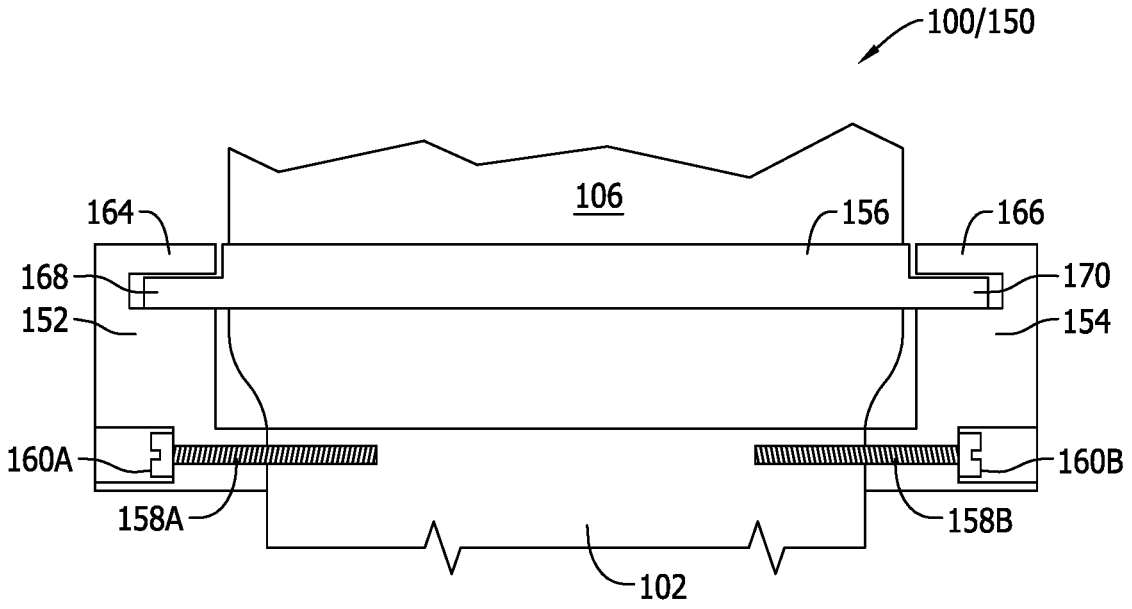
FIG. 6 is a partial cross-sectional view of the marine propeller assembly of FIG. 3.

FIG. 6 is a partial cross-sectional view of propeller assembly 100. In the example embodiment, fairing structure 150 includes first retention member 152 and second retention member 154, which are coupled to hub 102 by one or more fasteners, such as, but not limited to, one or more threaded fasteners 158A, 158B, for example, one or more bolts. In the example embodiment, heads 160A, 160B of fasteners 158A, 158B are countersunk into longitudinally outer surfaces of first retention member 152 and second retention member 154, respectively. First retention member 152 includes a first radial interference member 164 and second retention member includes a second radial interference member 166. Fairing platform 156 is configured to engage first radial interference member 164 and second radial interference member 166 such that during operation of propeller assembly 100, first radial interference member 164 and second radial interference member 166 limit radial motion of fairing platform 156. For example, fairing platform 156 includes a forward platform retention member 168 complementary to first radial interference member 164 and an aft platform retention member 170 complementary to second radial interference member 166. Forward platform retention member 168, for example, is retained by first radial interference member 164 by a first tongue and groove engagement in which forward platform retention member 168 includes a tongue and first radial interference member 164 defines a groove. Aft platform retention member 170 is retained by second radial interference member 166 by a second tongue and groove engagement in which aft platform retention member 170 includes a tongue and second radial interference member 166 defines a groove.

Figure 7:
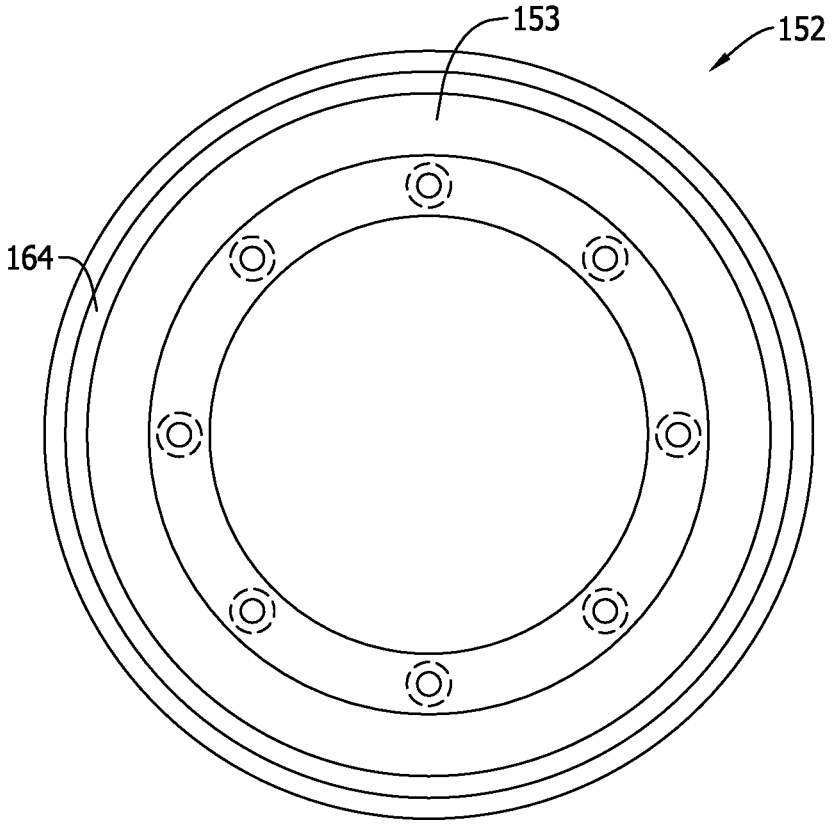
FIG. 7 is an alternative view of a first retention member of the propeller assembly of FIG. 3.

FIG. 7 is an alternative view of first retention member 152. More particularly, FIG. 7 is a view of an aft face 153 of first retention member 152. In the example embodiment, first retention member 152 extends circumferentially about aft face 153. For example, first retention member 152 is depicted as a groove extending continuously around aft face 153. In other embodiments, first retention member 152 may be discontinuous. For example, first retention member 152 may be continuous only in portions of aft face 153 corresponding to inter-blade gaps. In certain embodiments, second retention member 154 may include a forward face similar to aft face 153 about which second retention member 154 extends.

In the example embodiment of propeller assembly 100, fairing platform 156 is configured to be floatingly retained by each of first retention member 152 and second retention member 154. The term "floatingly retained" is used herein to describe retention in which clearance between fairing platform 156 and each of first retention member 152 and second retention member 154 facilitates at least some movement of fairing platform 156 in at least one direction. For example, in certain embodiments, such clearance facilitates fairing platform 156 to move circumferentially about hub 102 between adjacent blades 106. By doing so, flexing or bending of blades 106 caused by loading during operation is not impeded by fairing platform 156 and any stresses induced by fairing platform 156 on 106 is reduced.

Figure 8:
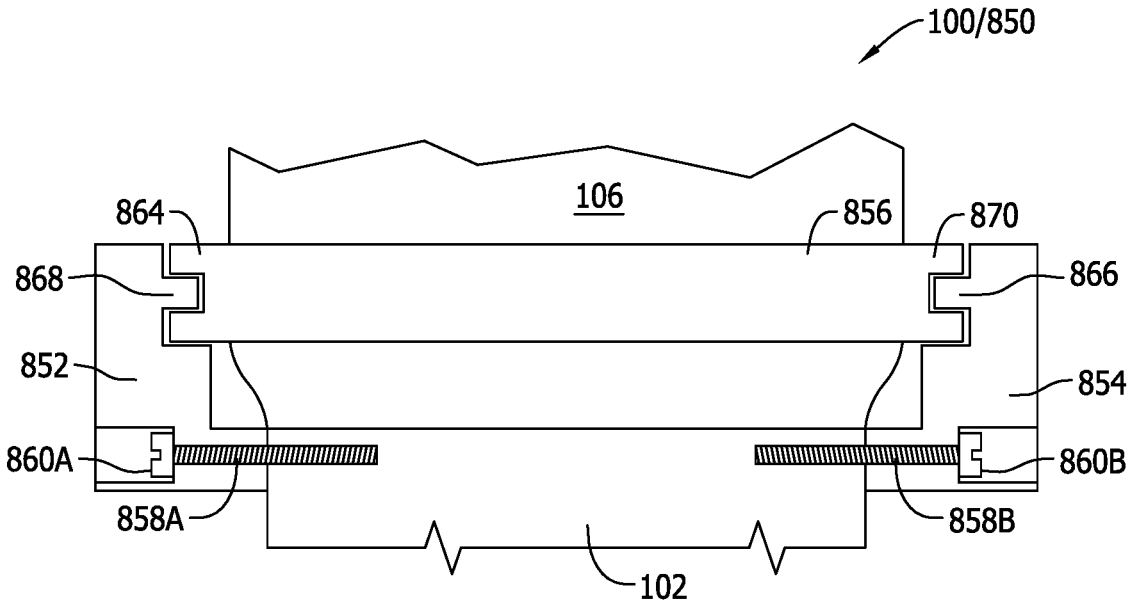
FIG. 8 is a partial cross-sectional view of the propeller assembly of FIG. 3 including a first alternative fairing structure.

FIG. 8 is a partial cross-sectional view of propeller assembly 100 including a fairing structure 850 according to another alternative embodiment. In the alternative embodiment, fairing structure 850 includes first retention member 852 and second retention member 854, which are coupled to hub 102 by one or more fasteners, such as, but not limited to, one or more threaded fasteners 858A, 858B, for example, one or more bolts. In the example embodiment, heads 860A, 860B of fasteners 858A, 858B are countersunk into longitudinally outer surfaces of first retention member 852 and second retention member 854, respectively. First retention member 854 includes a first radial interference member 864 and second retention member includes a second radial interference member 866. Fairing platform 856 is configured to engage first radial interference member 864 and second radial interference member 866 such that during operation of propeller assembly 100, first radial interference member 864 and second radial interference member 766 limit radial motion of fairing platform 856. For example, fairing platform 856 includes a forward platform retention member 868 complementary to first radial interference member 864 and an aft platform retention member 870 complementary to second radial interference member 866. Forward platform retention member 868, for example, is retained by first radial interference member 864 by a first tongue and groove engagement in which forward platform retention member 868 defines a groove and first radial interference member 864 includes a tongue. Aft platform retention member 870 is retained by second radial interference member 866 by a second tongue and groove engagement in which aft platform retention member 870 defines a groove and second radial interference member 866 includes a tongue.

Figure 9:
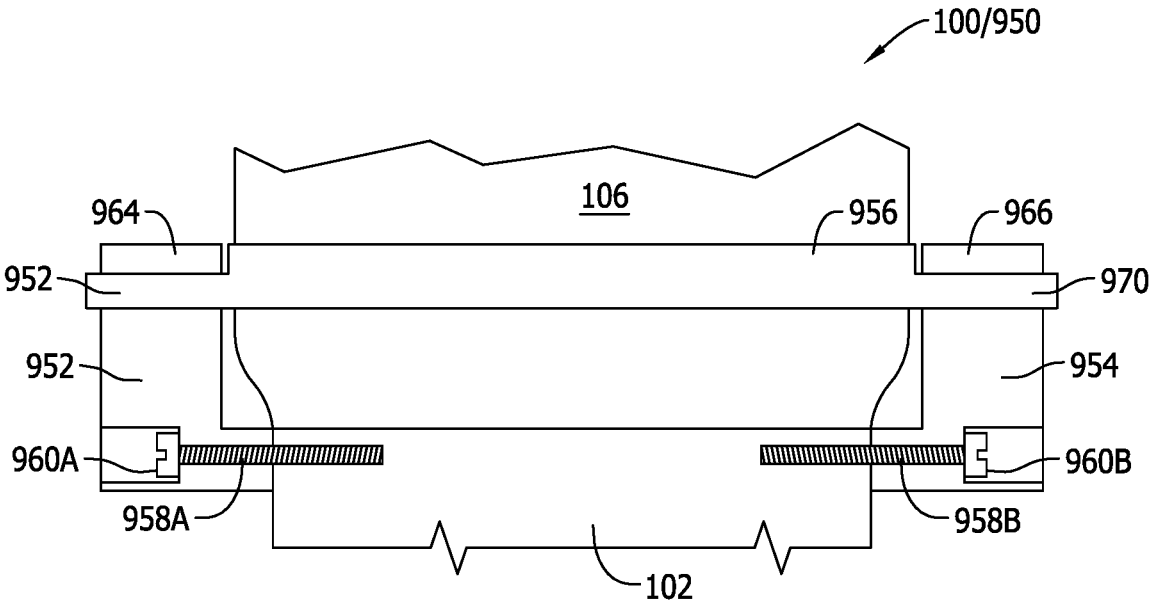
FIG. 9 is a partial cross-sectional view of the propeller assembly of FIG. 3 including a second alternative fairing structure.

FIG. 9 is a partial cross-sectional view of propeller assembly 100 including a fairing structure 950 according to an alternative embodiment. In the alternative embodiment, fairing structure 950 includes first retention member 952 and second retention member 954, which are coupled to hub 102 by one or more fasteners, such as, but not limited to, one or more threaded fasteners 958A, 958B, for example, one or more bolts. In the example embodiment, heads 960A, 960B of fasteners 958A, 958B are countersunk into longitudinally outer surfaces of first retention member 952 and second retention member 954, respectively. First retention member 952 includes a first radial interference member 964 and second retention member includes a second radial interference member 966. For example, fairing platform 956 includes a forward platform retention member 968 complementary to first radial interference member 964 and an aft platform retention member 970 complementary to second radial interference member 966. Fairing platform 956 is configured to engage first radial interference member 964 and second radial interference member 966 such that during operation of propeller assembly 100, first radial interference member 964 and second radial interference member 966 limit radial motion of fairing platform 956. Forward platform retention member 968, for example, is retained by first radial interference member 964 in a first mortise and tenon engagement and aft platform retention member 970 by a second radial interference member 966 in a second mortise and tenon engagement.

The tongue and groove engagement of FIG. 8 and the mortise and tenon engagement of FIG. 9 are intended merely as examples of engagements for retaining the fairing platform. As previously discussed in the context of propeller assembly 100 (shown in FIG. 1), fairing platform 156 is configured to be floatingly retained by each of first retention member 152 and second retention member 154. Accordingly, in other embodiments, engagements other than a tongue and groove engagement and a mortise and tenon engagement are used to retain the fairing platform. For example, in one alternative embodiment, the fairing platform is retained by inserting a pin through holes defined by the first and the second retention members and into a similar hole defined by the fairing platform.

Fairing platforms according to certain embodiments of the present disclosure are generally configured to improve fluid flow characteristics of propeller assemblies during operation as compared to fluid flow characteristics of propeller assemblies absent such fairing platforms. For example, fairing platform 156 is configured to improve flow characteristics of propeller assembly 100 (as shown in FIG. 1) as compared to flow characteristics of propeller assembly 100 absent fairing platform 156, i.e., flow characteristics of propeller assembly 100 based on fluid flow over outer hub surface 122. For purposes of this disclosure, a propeller assembly having a fairing platform is said to have a higher flow coefficient than the same propeller assembly lacking the fairing platform. The term "flow coefficient" is used herein to denote a value that indicates the relative performance of a propeller assembly. A flow coefficient may be based on, but is not limited to being based on one or more of: (i) an amount of cavitation during operation; (ii) generated thrust; (iii) open water efficiency; (iv) hull efficiency; (v) relative rotative efficiency; (vi) mechanical efficiency; (vii) a quasi-propulsive coefficient; and (viii) acoustic efficiency.

In light of the foregoing, a method of manufacturing a fairing structure including a fairing platform may generally include determining a first flow coefficient of a propeller assembly including a central hub without a fairing structure. Such a determination may be made using techniques including, but not limited to, physical testing of a full-scale or reduced-scale version of the propeller assembly and computer modelling of the propeller assembly. Next, a platform profile for a radially outer surface of the fairing platform may be determined such that a second propeller assembly including a fairing platform having the platform profile has a second flow coefficient greater than the first coefficient. The fairing platform may then be formed such that the radially outer surface of the fairing platform substantially conforms to the platform profile. The fairing platform may be formed by any suitable manufacturing technique including, but not limited to one or more of casting, machining, additive manufacturing (such as 3D printing), injection molding, hydroforming, and stamping.

The above-described marine propeller systems provide a method for improving flow characteristics of a marine propeller assembly. Specifically, the above-described marine propeller system includes a fairing structure that improves the flow coefficient of the propeller assembly by facilitating the use of a fairing platform for use between adjacent blades of the propeller assembly. The fairing platform may be formed to have improved flow characteristics as compared to the central hub of the propeller assembly.

An exemplary technical effect of the methods, systems, and apparatus described herein includes at least one of: (a) improving overall efficiency of the propeller assembly; (b) increasing propulsion produced by the propeller assembly for a given drive; (c) reducing the drive required to achieve a desired level of propulsion; and (d) facilitating the use of separable composite blades in a propeller assembly.

Exemplary embodiments of marine propeller systems are described above in detail. The marine propeller systems, and methods of manufacturing such systems and component devices are not limited to the specific embodiments described herein, but rather, components of the systems and/or steps of the methods may be utilized independently and separately from other components and/or steps described herein. For example, the methods may also be used in combination with other propeller-related systems, and are not limited to practice with only the systems and methods as described herein. Rather, the exemplary embodiment can be implemented and utilized in connection with many other machinery applications that are currently configured to receive and accept propeller assemblies.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A propeller assembly, comprising:

a central hub comprising a forward end, an aft end, and a hub body extending therebetween along an axis of rotation of said central hub; a plurality of blades extending from said central hub, each of said plurality of blades being connected to said central hub with a dovetail joint, said dovetail joint having a curved portion that is curved around the axis of rotation of said central hub;

a first retention member including a first radial interference member having a first complementary feature that defines a first engagement, said first retention member coupled to said forward end of said central hub;

a second retention member including a second radial interference member having a second complementary feature that defines a second engagement, said second retention member coupled to said aft end of said central hub; and a fairing platform that is separable from the plurality of blades and said central hub, said fairing platform extending between said first retention member and said second retention member, wherein said fairing platform is retained by said first engagement of said first radial interference member and by said second engagement of said second radial interference member.

2. A propeller assembly in accordance with claim 1, wherein at least one of the first radial interference member and the second radial interference member limit the radial motion of the fairing platform.

3. A propeller assembly in accordance with claim 1, wherein said fairing platform extends between two adjacent blades of said plurality of blades.

4. A propeller assembly in accordance with claim 3, wherein said plurality of blades is separable from said central hub.

5. A propeller assembly in accordance with claim 3, wherein said plurality of blades comprises at least one of a metal material, a composite material, and a combination thereof.

6. A propeller assembly in accordance with claim 1, wherein said first retention member further comprises an aft face, said first radial interference member circumscribing said aft face, and said second retention member further comprises a forward face, said second radial interference member circumscribing said forward face.

7. A propeller assembly in accordance with claim 1, wherein said fairing platform is floatingly retained by at least one of said first retention member and said second retention member such that a clearance between said fairing platform and at least one of said first retention member and said second retention member facilitates at least some movement of said fairing platform in at least one direction.

8. A propeller assembly in accordance with claim 1, wherein said fairing platform further comprises: a forward platform retention member complementary to said first complementary feature of said first radial interference member and configured to be retained by first complementary feature of said first radial interference member; and an aft platform retention member complementary to said second complementary feature of said second radial interference member and configured to be retained by said second complementary feature of second radial interference member.

9. A propeller assembly in accordance with claim 8, wherein at least one of the first engagement and the second engagement is one of a tongue and groove engagement and a mortise and tenon engagement.

10. A propeller assembly in accordance with claim 1, wherein said hub comprises a radially outer hub surface having a first flow coefficient, said fairing platform comprises a radially outer platform surface having a second flow coefficient, and said second flow coefficient is greater than said first flow coefficient.

11. A propeller assembly in accordance with claim 10, wherein said first coefficient and said second coefficient relate to at least one of: (i) an amount of cavitation during operation; (ii) generated thrust; (iii) open water efficiency; (iv) hull efficiency; (v) relative rotative efficiency; (vi) mechanical efficiency; (vii) a quasi-propulsive coefficient; and (viii) acoustic efficiency.

12. A propeller assembly in accordance with claim 1, wherein said central hub includes a plurality of dovetail grooves, each of said plurality of dovetail grooves being configured to receive a wedge and a dovetail of one of said plurality of blades.

13. A fairing structure supportable by a central hub of a propeller assembly, the central hub including a forward end, an aft end, and a hub body extending therebetween along an axis of rotation of the central hub, said fairing structure comprising:

a first retention member including a first radial interference member having a first complementary feature that defines a first engagement, said first retention member couplable to the forward end of the central hub;

a second retention member including a second radial interference member having a second complementary feature that defines a second engagement, said second retention member couplable to the aft end of the central hub; and a fairing platform that is separable from a plurality of blades and said central hub, said plurality of blades being connected to said central hub with a dovetail joint, said dovetail joint having a curved portion that is curved around the axis of rotation of said central hub, said fairing platform extending from said hub body, the fairing platform extending between said first retention member and said second retention member, said fairing platform engaging said first engagement of said first radial interference member and said second engagement of said second radial interference member.

14. A fairing structure in accordance with claim 13, wherein at least one of the first radial interference member and the second radial interference member limit the radial motion of the fairing platform and wherein said fairing platform is configured to be floatingly retained by each of said first retention member and said second retention member.

15. A fairing structure in accordance with claim 13, wherein said first retention member further comprises an aft face, said first radial interference member circumscribing said aft face, and said second retention member further comprises a forward face, said second radial interference member circumscribing said forward face.

16. A fairing structure in accordance with claim 13, wherein said fairing platform further comprises: a forward platform retention member complementary to said first radial interference member and configured to be retained by said first radial interference member; and an aft platform retention member complementary to said second radial interference member and configured to be retained by said second radial interference member.

17. A fairing structure in accordance with claim 16, wherein said first radial interference member and said first retention member comprise first complementary features that define said first engagement, said second radial interference member and said second retention member comprise second complementary features that define said second engagement, and at least one of the first engagement and the second engagement is one of one of a tongue and groove engagement and a mortise and tenon engagement.

18. A fairing structure in accordance with claim 13, wherein the hub includes a radially outer hub surface having a first flow coefficient, said fairing platform comprises a radially outer platform surface having a second flow coefficient, and said second flow coefficient is greater than the first flow coefficient.

19. A fairing structure in accordance with claim 18, wherein said first coefficient and said second coefficient relate to at least one of: (i) an amount of cavitation during operation; (ii) generated thrust; (iii) open water efficiency; (iv) hull efficiency; (v) relative rotative efficiency; (vi) mechanical efficiency; (vii) a quasi-propulsive coefficient; and (viii) acoustic efficiency.

20. A fairing structure in accordance with claim 13, wherein said central hub includes a plurality of dovetail grooves, each of said plurality of dovetail grooves being configured to receive a wedge and a dovetail of one of said plurality of blades.

* * * * *